United States Patent [19]

Davcev

[11] Patent Number: 4,908,587

[45] Date of Patent: Mar. 13, 1990

[54] ANTENNA SELECTOR

[75] Inventor: Stojan Davcev, Skopje, Yugoslavia

[73] Assignee: ASEA Brown Boveri Ltd., Baden, Switzerland

[21] Appl. No.: 301,829

[22] Filed: Jan. 26, 1989

[30] Foreign Application Priority Data

Jan. 26, 1988 [CH] Switzerland ..... 261/88

[51] Int. Cl.[4] ..... H01P 1/10

[52] U.S. Cl. ..... 333/101; 333/106; 343/853

[58] Field of Search ..... 333/101, 105, 106; 343/850, 853, 858; 340/825.79; 200/175, 504

[56] References Cited

U.S. PATENT DOCUMENTS

| | | | |
|---|---|---|---|
| 3,260,967 | 7/1966 | McClaflin et al. | 333/105 |
| 3,534,193 | 10/1970 | Nelson | 200/175 X |
| 3,588,390 | 6/1971 | Kerschner et al. . | |
| 3,885,117 | 5/1975 | Owen . | |
| 4,070,637 | 1/1978 | Assal et al. | 333/105 |
| 4,811,032 | 3/1989 | Boksberger et al. | 343/850 X |

FOREIGN PATENT DOCUMENTS

| | | |
|---|---|---|
| 8705155 | 8/1987 | European Pat. Off. . |
| 938348 | 9/1948 | France . |
| 298004 | 6/1954 | Switzerland . |
| 727081 | 3/1955 | United Kingdom . |
| 844465 | 8/1960 | United Kingdom . |
| 927388 | 5/1963 | United Kingdom . |
| 2013409 | 8/1979 | United Kingdom . |

OTHER PUBLICATIONS

BBC Brown Boveri AG No. 3798D (10.71-1500), "HF-Antennenwahler 500 kW", (Radio-Frequency Antenna Selector 500 kW), (1971).

Brown Boveri Mitteilungen (Brown Boveri bulletins), vol. 44, No. 10, (1957), pp. 446-450.

*Primary Examiner*—Paul Gensler

*Attorney, Agent, or Firm*—Oblon, Spivak, McClelland, Maier & Neustadt

[57] ABSTRACT

In an antenna selector in the form of a matrix, in which connections are established as desired between first feeder lines (F11, . . . , F13) on a first level and second feeder line (F21, . . . , F24) on a second level, the number of switches (S11, . . . , S34) can be reduced or the number of selectable antennae can be increased, in that at least one third level with third feeder lines (F31, . . . , F34) is introduced and each switch (S11, . . . , S34) is extended by an additional switching level and switching position.

7 Claims, 6 Drawing Sheets

ANTENNA SELECTOR

BACKGROUND OF THE INVENTION

1. Field of the Invention

The present invention relates to the field of transmitter technology. In particular it concerns an antenna selector in the form of a switching matrix for the optional connection of a plurality of transmitters to a plurality of antennae, in which antenna selector on a first level a plurality of first feeder lines are arranged parallel to one another, one transmitter connection being associated with each of the first feeder lines;

on a second level parallel to the first level a plurality of second feeder lines are arranged parallel to one another and at right angles to the first feeder lines, one first antenna connection being associated with each of the second feeder lines;

there is provided at the intersections of the first and second feeder lines in each case a switch which has a corresponding switching level on each of the levels, and which in a first switching position connects through individually the associated first feeder line and the associated second feeder line, and in a second switching position disconnects the associated first and second feeder line and mutually connects them. An antenna selector of this kind is known, for example, from the Swiss Patent Specification 298,004.

2. Discussion of Background

Large transmitter systems, in particular shortwave transmitting stations, contain, except in special cases, a large number of antennae since the most favourable operating frequencies change, for example, depending on the time of day or year, and moreover depend on the transmission distance and the geographic direction, but the antennae usually cover in each case only a narrow frequency range. Since, moreover, directional radiation is for the most part employed, several antennae are usually required for each direction.

Owing to the versatility of the transmitting program, such transmitting systems usually also contain a plurality of transmitters.

Full utilization of the transmitting system is therefore only provided if there is a clear and quick switchover device which is simple to operate and reliable and which permits each of the transmitters to be connected to each of the antennae as desired.

Since the transmitting systems as a rule contain a greatly differing number of transmitters and antennae, and since existing systems are also frequently expanded later, it is particularly expedient and economic to build the switchover device in modular fashion. Such an antenna selector in the form of a matrix has been described in the publication mentioned at the beginning.

The rows of the matrix are associated there with the transmitters, and the columns of the matrix with the antennae. The elements of the matrix are formed by individual switches.

In the known antenna selector, the switching operation takes place on two levels: on the first level there run first feeder lines parallel to one another which are fed by the transmitters and which correspond to the rows of the matrix.

On the second level there run, likewise parallel to one another, but at right angles to the first feeder lines, second feeder lines which feed the radio-frequency power of the transmitter into the antennae and which correspond to the columns of the matrix.

Since the two levels are arranged above one another, the first and second feeder lines intersect. At these intersections there are then in each case switches with two switching levels. Each switching level corresponds to a feeder line level.

In the conventional matrix, the switches have two switching positions: in the first switching position the first feeder line running through the respective intersection is connected through on the one switching level. The same takes place on the other switching level with the corresponding second feeder line. Both feeder lines conduct the radio-frequency power through this intersection without interference and without changing the direction.

In the second switching position, both through connections are cancelled. Instead, the switch end of the first feeder line is connected up to the switch beginning of the second feeder line via a fixed wire bridge which runs within the switch between the two switching levels. A diagonal line connection results which redirects the power fed in by the transmitter to the antenna associated with the switch. Depending on the switching position of the switch, each transmitter can thus be connected to each antenna (even in different ways).

In the case of large shortwave transmitting systems in which each transmitter has in a frequency range of approximately 3–30 MHz outputs of several 100 kW, and the feeder lines are designed as symmetrical lines with a wave impedance of, for example, 300 ohm, each of the cuboid switches has a depth of approximately one meter and a base area of approximately $0.5 \times 0.5$ m$^2$.

If such a transmitting system now contains $T_n$ transmitters and $A_m$ antennae, for the known antenna selector $$S_K = T_n \cdot A_m$$

switches are required, which are all combined beside one another to form a matrix. With only four transmitters ($T_n = 4$) and sixteen antennae ($A_m = 16$), this already amounts to $S_K = 64$ individual switches, which not only require a considerable space, but which must all be equipped individually with corresponding motor drives and monitoring and control elements. This entails a considerable outlay, which forms a decisive part of the costs for the overall transmitting system.

SUMMARY OF THE INVENTION

Accordingly, one object of this present invention is to provide a novel antenna selector in which, with the same number of antennae, considerably fewer switches suffice, or with the same number of switches, permits the selection of a far greater number of antennae, and which at the same time has the advantages of the known matrix antenna selectors.

The object is achieved in an antenna selector of the type mentioned at the beginning in that there are arranged on a third level parallel to the first two levels a plurality of third feeder lines parallel to one another and at right angles to the first feeder lines, a second antenna connection being associated with each of the third feeder lines;

the intersections of the first and third feeder lines coincide with corresponding intersections of the first and second feeder lines; and each switch has a switching level corresponding to the third level, and in the first switching position also connects through the associated third feeder line, in the second switching position also disconnects the associated third feeder line, and in a third switching position disconnects all three associated feeder lines and only mutually connects the associated first and third feeder line.

The core of the invention thus consists in providing each existing switch of an antenna selector matrix with an additional switching function by means of a third switching level. With this additional switching level and switching function, by means of an additional switching position, the first feeder lines coming from the transmitters can then be connected optionally to additional third feeder lines which, arranged like the second feeder lines, run on a new third level.

With these third feeder lines on a third level of the matrix, as many antennae can then be selected again as with the second feeder lines of the second level, so that the number of selectable antennae is doubled in principle with the same number of switches.

Although each switch must be extended by one switching level and one switching function, the antenna selector according to the invention results in considerable space saving.

At the same time as with the required space, drive and control devices for the antenna selector are also saved, since each switch now performs the switching function for two antennae.

In addition, the antenna selector according to the invention can be constructed in the same modular fashion, so that a variety of different applications can be covered with standard components.

According to a preferred exemplary embodiment of the invention, all feeder lines are designed as symmetrical lines. This line type, which is used above all in the shortwave field, permits a simple internal wiring of the switches and the use of comparatively simple switch contacts.

It is particularly favourable for a simple internal switch wiring if, according to a further advantageous embodiment of the invention, the first level of the transmitter feeder lines is arranged between the second and third level of the antenna feeder lines, because then the necessary wire bridges between these switching levels require particularly little space.

Further embodiments of the invention can be found in the subclaims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
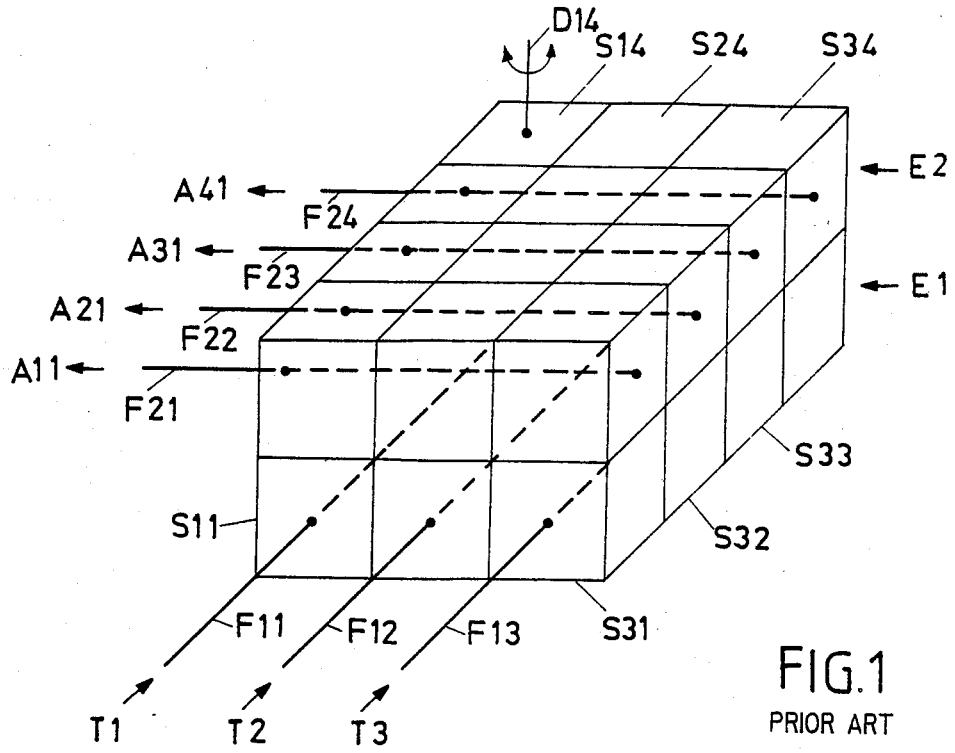
FIG.1 PRIOR ART
FIG. 1 shows the diagrammatic construction of a conventional antenna selector matrix.
Figure 2:
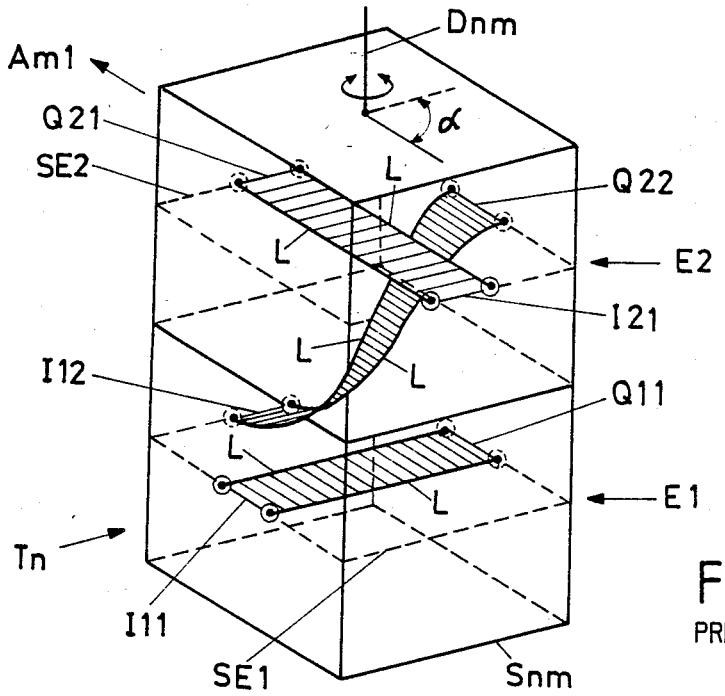
FIG.2 PRIOR ART
FIG. 2 shows the diagrammatic construction of a switch from the matrix according to FIG. 1.
Figure 3:
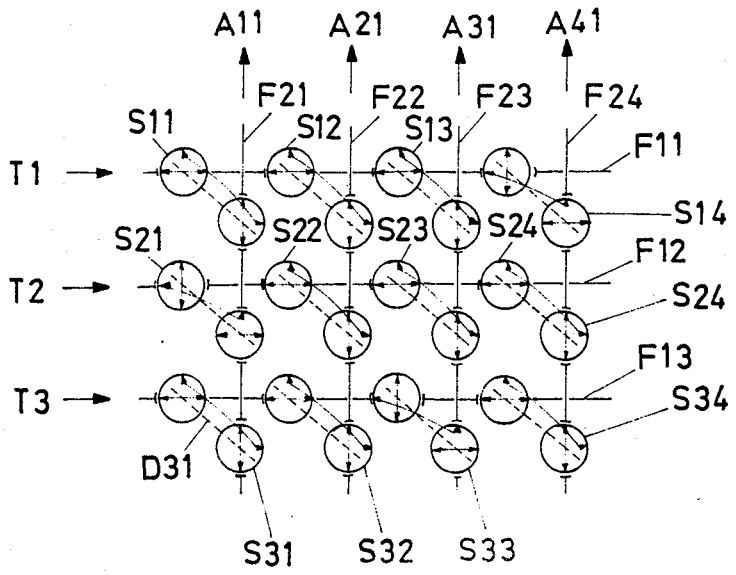
FIG.3 PRIOR ART
FIG. 3 shows the exemplary switching state of a conventional (3×4) matrix in a 2-dimensional representation.

Referring now to the drawings, wherein like reference numerals designate identical or corresponding parts throughout the several views, in FIGS. 1 to 3 the construction of an antenna selector matrix for symmetrical lines, as is known from the prior art, is illustrated.

FIG. 1 shows a diagrammatic perspective view of such a conventional (3×4) matrix, with which 3 transmitters and 4 antennae can be connected as desired. Said matrix has a first level E1 and a second level E2.

On the first level E1, first feeder lines F11, . . ., F13 which start from corresponding transmitter connections T1, . . ., T3 and into which the radio-frequency power is fed in from the transmitters run parallel to one another.

On the second level E2, which is arranged parallel to and above the first level E1, there run, likewise parallel to one another but at right angles to the first feeder lines F11, . . ., F13, second feeder lines F21, . . . , F24 which lead to corresponding antenna connections A11, . . ., A41, and which carry away the radiofrequency power to the respective antennae, inasmuch as a corresponding switch was performed in the matrix. Owing to the arrangement of the first and second feeder lines at right angles to one another, intersections are produced. A switch is provided at each of these intersections, the switch with the general reference numeral Snm being situated just at the intersection of the feeder lines from the transmitter connection Tn and to the antenna connection Am1 (in FIG. 1, the switches S11; S14; . . ., S34 and S31, . . ., S33 are provided with reference symbols as examples).

Each of the switches is represented diagrammatically in FIG. 1 as a double cube. It contains in each case a switching device, not shown, which can be rotated about an axis of rotation (D14 for switch S14 in FIG. 1) lying at right angles to the levels E1, E2.

FIG. 2 provides further details of the internal construction of a switch Snm. The switch Snm contains, corresponding to the two levels E1 and E2, two switching levels SE1 and SE2. At the same time it has two switching positions which merge into one another by a rotation of $\alpha=90°$ about the axis of rotation Dnm. The first of the two switching positions is illustrated in FIG. 2.

In this first switching position, the associated first feeder line (which comes from transmitter connection Tn) is connected through in the switch on the first switching level SE1. Likewise, the associated second feeder line (which leads to the antenna connection Am1) is connected through in the switch on the second switching level SE2.

For this purpose, on the first and second switching level SE1 and SE2 in each case a first input I11 or I21 is connected firmly to an opposite first output Q11 or Q21 by a pair of wire bridges L (the association of two wire bridges L of a pair to a symmetrical line is marked in FIG. 2 by shading).

Each of the two wire bridge pairs realizes in the illustrated first switching position the through connection of the associated feeder lines on the various levels. If, therefore, all 12 switches of the matrix from FIG. 1 are in this first switching position, no switched connection exists between the first feeder lines F11, . . ., F13 and the second feeder lines F21, . . ., F24.

This changes, however, as soon as one of the switches Snm is operated, that is rotated by the angle $\alpha=90°$. All wire bridges L within the switch then rotate by the same angle (second switching position).

In this case, on the switching level SE1 a second input I12 takes the place of the first input I11. Accordingly, on the switching level SE2 a second output Q22 takes the place of the first output Q21. The second input I12 of the first switching level SE1 and the second output Q22 of the second switching level SE2 are now likewise connected by a pair of wire bridges L. This pair connects in the second switching position the associated first feeder line to the associated second one (that is the transmitter connection Tn to the antenna connection Am1), while as a result of the rotation of the remaining wire bridges L, the through connection on both levels E1 and E2 is cancelled. Since this diagonal connection is made, seen from the transmitter, to the left, the switch version according to FIG. 2 is also termed left-switch.

In a right-switch (not shown), the second input I12 and the second output Q22 lie on the opposite side of their respective switching level SE1 or SE2. In order to reach the second switching position, a switch of this kind must be rotated by 90° in the opposite direction. The antenna connections then lie, seen from the transmitter, on the right side of the matrix.

The exemplary switching state of a known (3×4) matrix is illustrated in FIG. 3 in a 2-dimensional representation. The two switching levels of each switch are indicated thereby by circles offset in perspective, which are connected by an axis of rotation (e.g. D31 for switch S31) drawn with a dashed line. The inherently symmetrical feeder lines are here, as also in FIG. 1, indicated in each case by a single line for the sake of simplicity.

The switches S11, . . ., S13; S22, . . ., S24, S31, S32 and S34 are in the switching state shown in the first switching position, the remaining switches are in the second. Consequently, it can easily be seen that the first transmitter connection T1 is connected to the fourth antenna connection A41, the second transmitter connection T2 is connected to the first antenna connection A11, and the third transmitter connection T3 is connected to the third antenna connection A31.

Figure 4:
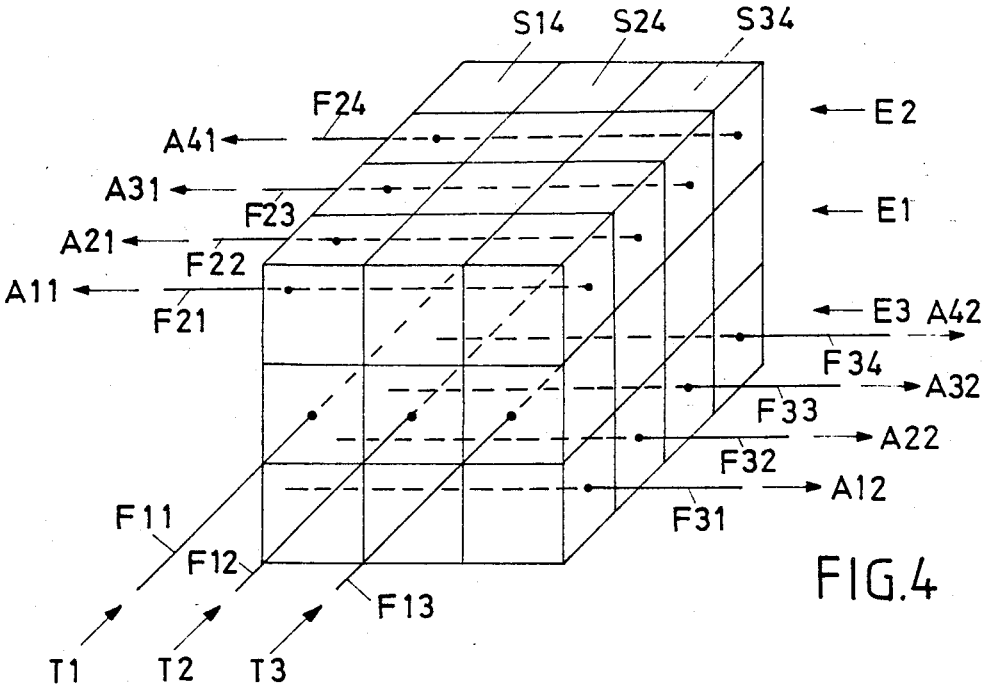
FIG. 4 shows the diagrammatic construction of an antenna selector according to the invention comparable to that of FIG. 1.

Starting from the (3×4) matrix of FIG. 1 with two levels, by adding at least one further third level and modifying the individual switches one obtains the antenna selector of the invention, an exemplary embodiment of which is represented in FIG. 4.

The third level E3 is arranged in this exemplary embodiment below the first level E1. It contains a number of third feeder lines F31, ..., F34 which lead to corresponding antenna connections A12, ..., A42.

The third feeder lines F31, ..., F34 run, exactly as the second feeder lines F21, ..., F24, parallel to one another and at right angles to the first feeder lines F11, ..., F13. They are moreover arranged so that they intersect the first feeder lines F11, ..., F13 at the same points as the second feeder lines F21, ..., F24.

Each of the switches is extended on the third level E3 by a third switching level and thus performs not only the selection of the left antenna connections (A11, . . . , A41), but also that of the right antenna connections (A12, ..., A42) so that with a (3×4) matrix now not only 4, but even 8 antennae can be selected.

Figure 5:
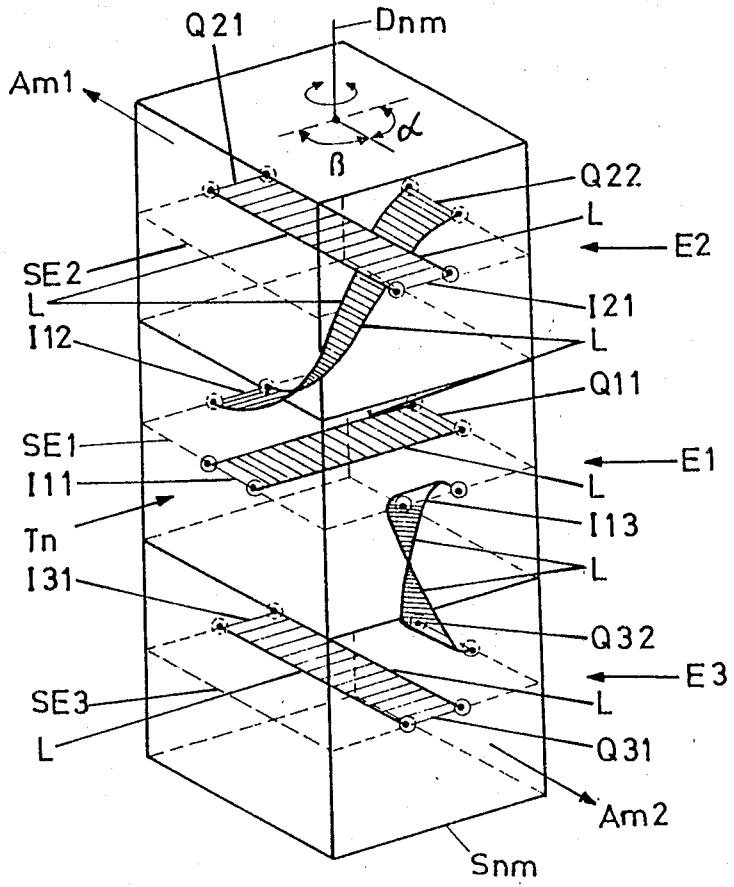
FIG. 5 shows the switch construction corresponding to that of FIG. 2 for a matrix according to FIG. 4 in the case of symmetrical feeder lines.

The modifiable switch Snm is shown in FIG. 5 in a form comparable to that of FIG. 2.

In the lower part of the switch Snm, a third level E3 with a corresponding switching level SE3 has been added to the levels E1 and E2 known already from FIG. 2.

This third switching level SE3 contains an input I31, an opposite first output Q31 and a second output Q32. The input I31 is firmly connected to the first output Q31 via a pair of wire bridges L.

The second output Q32 of the third switching level SE3 is connected with a comparable wire pair to a third input I13 on the first switching level, which is arranged opposite the second input I12 of this level.

The switch from FIG. 5 has three switching positions: in the first switching position the associated feeder lines are through connected on each switching level. This switching position corresponds thus to the first switching position of the known switch from FIG. 2.

In the second switching position (rotation by $\alpha=90°$) all three through connections are disconnected and only the associated first feeder line of the first level E1 is connected diagonally to the associated second feeder line of the level 2. This switching position thus corresponds to the second switching position of the known switch; the two upper switching levels SE1 and SE2 act here like the left-switch described above.

In contrast, a third switching position is new, in which the switch is rotated by $\beta=90°$ in the opposite direction out of the first switching position.

In this third switching position, all three through connections are in turn disconnected. On the first switching level SEI, the third input I13 takes the place of the first input I11. Likewise, on the third switching level SE3, the second output Q32 is switched in place of the first output Q31 to the outgoing third feeder line.

In this manner, the associated first feeder line is diagonally connected to the associated third feeder line; the first and third switching level SE1 and SE3 act here like the right-switch described above.

Figure 6:
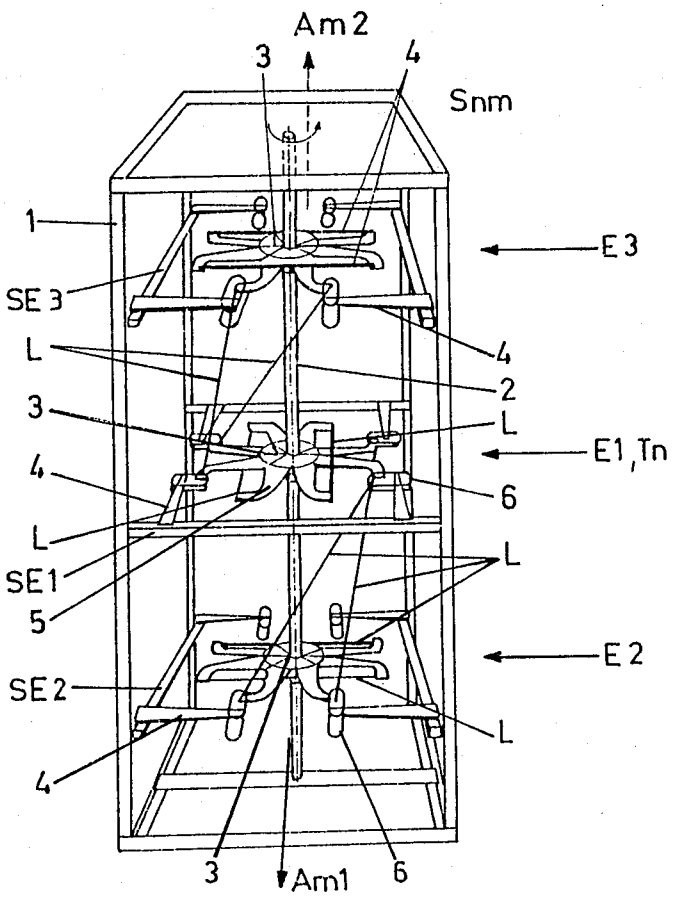
FIG. 6 shows a perspective representation of a tested embodiment of a switch according to FIG. 5.

The preferred embodiment of the switch according to FIG. 5 is illustrated in perspective in FIG. 6. The switch comprises a frame structure 1, in which a contact disc 3 is accommodated on each of the three switching levels SE1, ..., SE3. The contact discs 3 are situated on a common switching axis 2 and are composed in each case of several ceramic contact arms 5 which bear contacts on their external ends (not shown). One pair each of adjacent contact arms form one of the inputs or outputs on a switching level.

In particular switching positions, the contacts of these contact arm pairs engage with corresponding fixed contacts 6, which are attached on the outer ends of contact carriers 4 which are firmly mounted on the frame structure and are likewise ceramic.

The wire bridges L present in the switch, which are shown in FIG. 6 as thick lines, are made of copper tube with a special surface treatment.

In detail, all elements of the new switch can be executed exactly as with known switches, so that in this respect reference can be made, for example, to the publications Brown Boveri Mitteilungen (Brown Boveri bulletins), Volume 44, No. 10 (1957), pp. 446–450 or the company brochure of BBC Brown Boveri AG No. 3798D (10.71–1500) "HF-Antennenwähler 500 kW" (Radiofrequency antenna selector 500 kW), (1971).

With respect to the switch of FIG. 6, it should also be noted that the two wire bridge pairs running between the switching levels (SE1 and SE2 and SE1 and SE3 respectively) connected other inputs and outputs than in the switch of FIG. 5 (I13 and Q22, as well as I12 and Q32 instead of I12 and Q22, as well as I13 and Q32). Both solutions are equivalent, with the difference that in the switch of FIG. 6 the two upper switching levels SE1 and SE2 act as right-switches, while the two lower switching levels SE1 and SE3 act as left-switches. The positions of levels E2 and E3 are accordingly exchanged.

Figure 7:
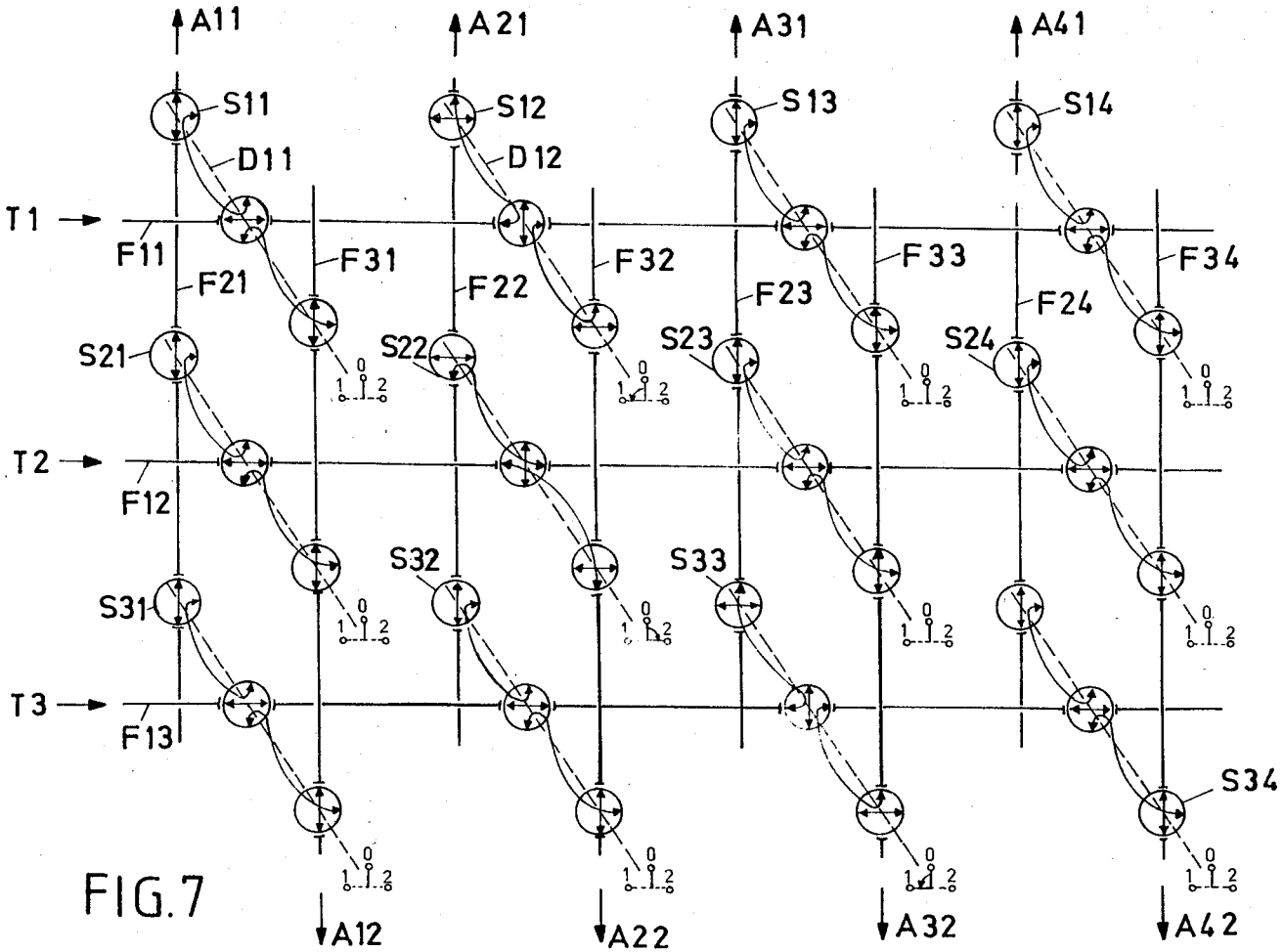
FIG. 7 shows the representation, comparable to that of FIG. 3, of an exemplary switching state of a (3×4) matrix according to the invention in a 3-dimensional representation.

An exemplary switching state of a (3×4) matrix with 3-dimensional switches in accordance with FIG. 6 is, analogous to FIG. 3, illustrated in FIG. 7. The respective switching position of a switch is denoted there by a symbol entered on the axis of rotation (0=first switching position; 1=second switching position; 2=third switching position).

In this example the switches S11, S13, S14, S21, S23, S24, S31, S32 and S34 are in the first switching position (0), the switches S12 and S33 are in the second switching position (1) and the switch S22 is in the third switching position (2). It can be seen immediately that in this manner the first transmitter connection T1 is connected to the antenna connection A21, the second transmitter connection T2 is connected to the antenna connection A22 and the third transmitter connection T3 is connected to the antenna connection A31.

As the representations in FIGS. 5 and 6 make clear, the mutual position of the levels can be exchanged as desired. In principle, however, further levels can be added beyond the third level E3 if corresponding switching levels and switching positions are provided in the switches.

Figure 8:
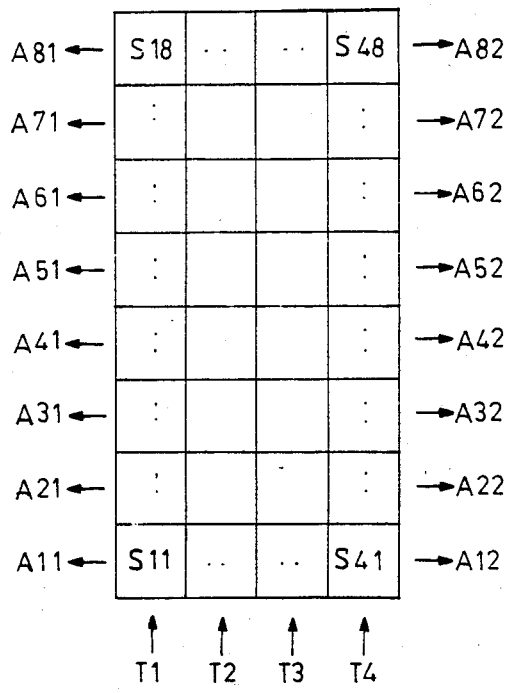
FIG. 8 shows the matrix diagram of a (4×8) matrix according to the invention.

As long as only a third level is added, the number $S_k$ of the switches is reduced from previously $T_n \times A_m$ to maximum $$S_k = \frac{T_n \times A_m}{2}$$

so that, as shown in FIG. 8, only 32 switches are required in a (4×8) matrix for 16 antenna connections A11, . . ., A81; A12, . . ., A82 and 4 transmitter connections T1, . . ., T4.

Figure 9:
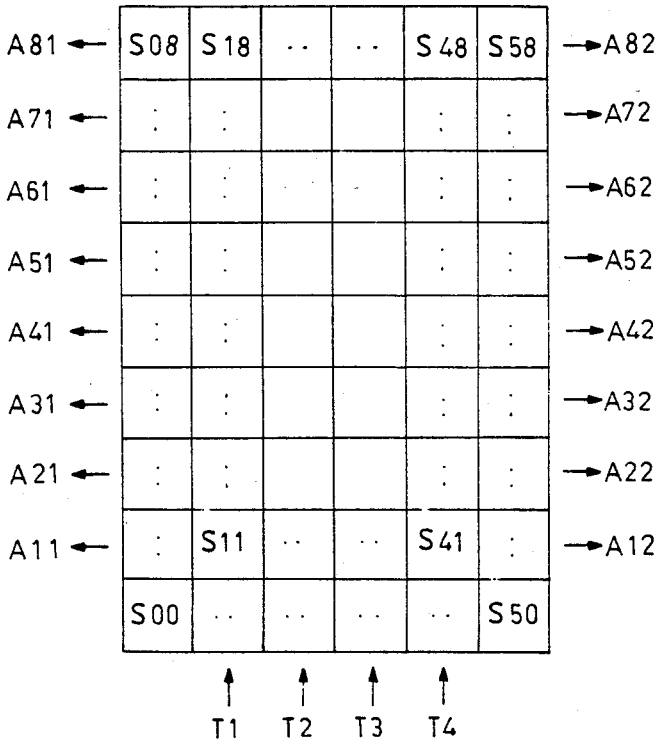
FIG. 9 shows the diagram corresponding to FIG. 8 for an extended (4×8) matrix with increased flexibility.

The flexibility of the antenna selector, that is the number of various ways with which particular antennae can be selected, can however be increased if, as shown in FIG. 9, the matrix is extended both on the transmitter side and on the antenna side in each case by at least one additional row of switches (S00, . . ., S08; S10, . . ., S40; S50, . . ., S58).

With this slight extension of the matrix, an increase of the flexibility in comparison to the known 2-dimensional matrix is even provided, since then it is also possible to bypass defective switches in the matrix. In this case the number $S_k$ of the switches is $$S_k = \frac{(T_n + 2)(A_m + 2)}{2} = a \cdot b$$

where $a = T_n + 2$ = number of rows in matrix $b = A_m + 2/2$ = number of columns in the matrix.

Figure 10:
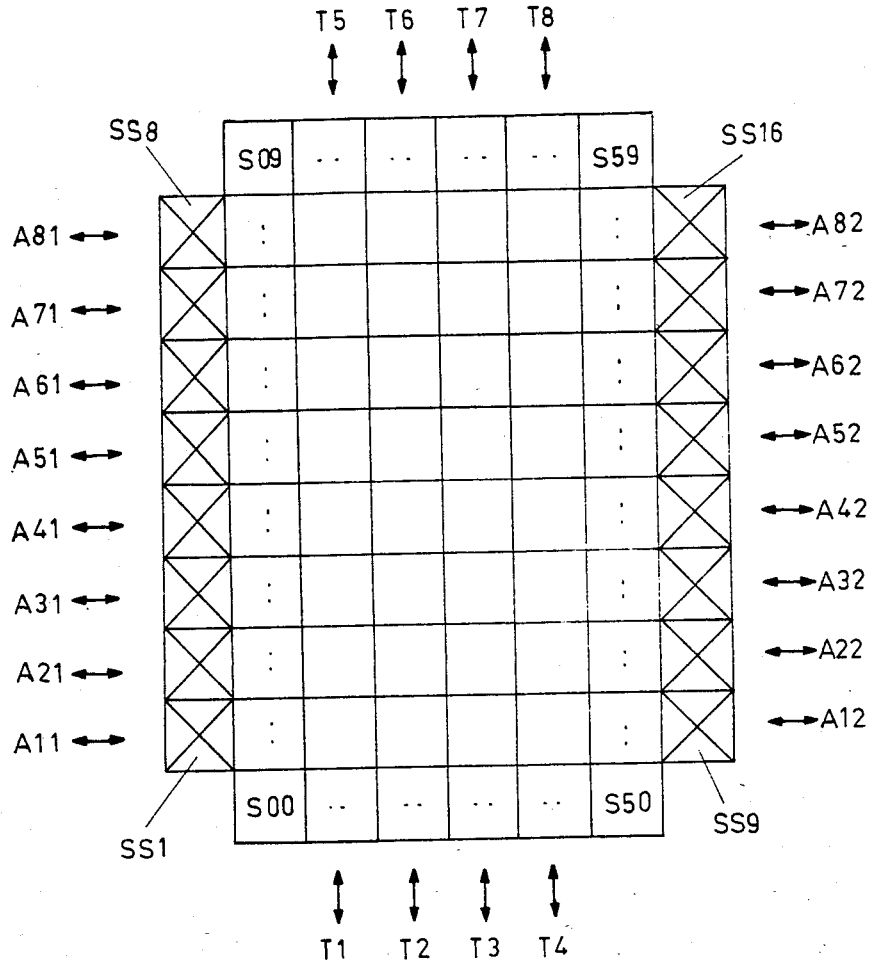
FIG. 10 shows the diagram corresponding to that of FIG. 8 for an extended (4×8) matrix with increased flexibility and optional assignment of the connections.

In addition to increasing the flexibility, it is also possible to achieve a free assignment of the connections, that is an optional exchange of antenna and transmitter connections if, according to FIG. 10 (in addition to an extension of the matrix by in each case adding an additional row of switches on all sides) a row of modified switches SS1, . . . SS8 or SS9, . . . SS16 is provided in each case on the sides of the antenna connections A11, . . ., A82.

These modified switches SS1, . . ., SS16 are constructed according to the principle of the switches from FIG. 5 so that they permit as desired a switchover from the second or third level E2 or E3 to the first level E1.

In this manner it is achieved that all matrix connections are located on the first level E1, on which otherwise only the transmitter connections T1, . . ., T4b are arranged.

All connections of the matrix (transmitter connections and antenna connections) are then equivalent and can be used as inputs or outputs.

Thus, for example, energy can be fed into the transmitter connections T1, . . ., T8 and removed at the antenna connections A11, . . ., A82 and vice versa (indicated by the double arrows in FIG. 8).

In summary, the invention provides an antenna selector which has the following advantages:

saving of switches possibility of bypassing switches.

Moreover, with an antenna selector according to the invention, the radio-frequency power of the transmitters can be fed into the first feeder lines from both sides if correspondingly modified switches are used, or all the antennae can be arranged on one side of the matrix. This also contributes to an increased adaptability of the antenna selector.

Obviously, numerous modifications and variations of the present invention are possible in the light of the above teachings. It is therefore to be understood that within the scope of the appended claims, the invention may be practiced otherwise than as specifically described herein.

What is claimed as new and desired to be secured by Letters Patent of the United States is:

1. An antenna selector in the form of a switching matrix for the optional connection of a plurality of transmitters to a plurality of antennae, in which antenna selector (a) on a first level (E1) a plurality of first feeder lines (F11, . . . , F13) are arranged parallel to one another, one transmitter connection (T1, . . . , T4) being associated with each of the first feeder lines (F11, ..., F13);

(b) on a second level (E2) parallel to the first level (E1) a plurality of second feeder lines (F21, ... , F24), are arranged parallel to one another and at right angles to the first feeder lines (F11, . . . , F13), one first antenna connection (A11, . . . , A81, Am1)

being associated with each of the second feeder lines (F21, ..., F24); and (c) there is provided at the intersections of the first and second feeder lines (F11, ..., F13 and F21, ..., F24 respectively) in each case a switch (S11, ..., S34) which has a corresponding switching level (SE1, SE2) on each of the levels (E1, E2), and which in a first switching position connects through the associated first feeder line on the first level (E1) and the associated second feeder line on the second level (E2), and in a second switching position interrupts the associated first and second feeder line on the respective level and mutually connects them from one level to the other; wherein (e) there is arranged on a third level (E3) parallel to the first two levels (E1, E2) a plurality of third feeder lines (F31, ..., F34) parallel to one another and at right angles to the first feeder lines (F11, . . ., F13), a second antenna connection (A12, . . ., A82, Am2) being associated with each of the third feeder lines (F31, . . ., F34);

(f) the intersections of the first and third feeder lines (F11, . . ., F13 and F31, . . ., F34 respectively) coincide with corresponding intersections of the first and second feeder lines (F11, . . ., F13 and F21, ..., F24 respectively); and (g) each switch has a switching level (SE3) corresponding to the third level (E3), and in the first switching position also connects through the associated third feeder line on the third level (E3), in the second switching position also interrupts the associated third feeder line on the third level (E3), and in a third switching position interrupts all three associated feeder lines on their respective levels and only mutually connects the associated first and third feeder lines from one level to the other.

2. An antenna selector as claimed in claim 1, wherein all feeder lines (F11, ..., F34) are designed as symmetrical lines.

3. An antenna selector as claimed in claim 2, wherein the first level (E1) is arranged between the second and third level (E2 and E3).

4. An antenna selector as claimed in claim 3, wherein the second antenna connections (A12, ..., A82, Am2) are arranged on the side of the switching matrix lying opposite the first antenna connections (A11, ..., A81, Am1).

5. An antenna selector as claimed in claim 3, wherein in the switches (S11, ..., S34)

(a) on each switching level (SE1, ..., SE3) a rotatable contact disc (3) is provided, all contact discs (3) being located above one another on a common switching axis (2) at right-angles to the levels (E1, ..., E3);

(b) the contact disc (3) of the first switching level (SE1) has three inputs (I11, ..., I13) and one output (Q11), and the contact discs (3) of the second and third switching levels (SE2) and (SE3) in each case have one input (I21) and (I31) and two outputs (Q21, Q22 and Q31, Q32);

(c) on each contact disc one input and one output (I11, Q11 and I21, Q21 and I31, Q31) lie opposite one another and are firmly connected to each other by wire bridges (L);

(d) the remaining outputs (Q22 and Q32) on the contact discs (3) of the second and third switching level (SE2 and SE3) are in each case firmly connected with one of the remaining inputs (112 and 113) on the contact disc (3) of the first switching level (SE1) by wire bridges (11);

(e) the three inputs (I11, ..., I13) on the contact disc of the first switching level (SE1) are arranged in each case mutually offset by 90°;

(f) the two outputs (Q21, Q22 and Q31, Q32) on the contact discs (3) of the second and third switching level (SE2 and SE3) are arranged in each case mutually offset by 90° C.; and (g) the inputs (I21 and I31) on the contact discs (3) of the second and third switching level (SE2 and SE3) are arranged opposite the first input (I11) on the contact disc of the first switching level (SE1) in each case rotated by 90° in the opposite direction.

6. An antenna selector as claimed in claim 1, wherein, to increase the flexibility, the switching matrix has on the sides of the transmitter connections (T1, ..., T4) and antenna Connections (A11, ..., A82, Am1, Am2) in each case at least one additional row of switches (S00, . . ., S08; S10, . . ., S40; S50, . . ., S58).

7. An antenna selector as claimed in claim 1, wherein, to increase the flexibility and for assigning the connections as desired, (a) the switching matrix has on all sides in each case at least one additional row of switches (S00, . . ., S09, . . ., S50, . . ., S59); and (S00, . . ., S09, . . ., S50, . . ., S59); and (b) there is provided on the sides of the antenna connections (A11, . . ., A82) in each case one additional row of switches (SS1, . . ., SS16), which switches (SS1, . . ., SS16) permit a switchover from either the second or third level (E2 and E3) to the first level (E1).

* * * * *